US006948751B2

(12) United States Patent
Wooten et al.

(10) Patent No.: US 6,948,751 B2
(45) Date of Patent: Sep. 27, 2005

(54) COLLAPSIBLE GRAPPLING HOOK

(75) Inventors: Donald W. Wooten, Dallas, TX (US); John W. Woodmansee, III, Plano, TX (US)

(73) Assignee: Tactical & Rescue Equipment, LLC, Plano, TX (US)

( * ) Notice: Subject to any disclaimer, the term of this patent is extended or adjusted under 35 U.S.C. 154(b) by 0 days.

(21) Appl. No.: 10/638,720

(22) Filed: Aug. 11, 2003

(65) Prior Publication Data

US 2004/0032139 A1 Feb. 19, 2004

Related U.S. Application Data

(63) Continuation of application No. 10/367,554, filed on Feb. 13, 2003, now abandoned, which is a continuation of application No. 09/993,861, filed on Nov. 14, 2001, now Pat. No. 6,530,614.

(60) Provisional application No. 60/248,383, filed on Nov. 14, 2000.

(51) Int. Cl.[7] ..... B66C 1/10

(52) U.S. Cl. ..... 294/82.1; 294/1.1

(58) Field of Search ..... 294/1.1, 82.1, 294/66.1; 114/297–299, 301–307

(56) References Cited

U.S. PATENT DOCUMENTS

| | | | | |
|---|---|---|---|---|
| 19,659 A | | 3/1858 | Williams | |
| 558,389 A | | 4/1896 | Hotmes | |
| 1,632,529 A | | 6/1927 | Bauer | |
| 3,485,199 A | * | 12/1969 | Schuman | 114/298 |
| 3,651,777 A | | 3/1972 | Ehrichmann | |
| 3,793,977 A | | 2/1974 | Ziegler | |
| 6,062,621 A | | 5/2000 | Zelazny | |
| 6,079,761 A | | 6/2000 | Sadeck | |
| 6,267,424 B1 | | 7/2001 | Gillette | |

* cited by examiner

*Primary Examiner*—Dean J. Kramer
(74) *Attorney, Agent, or Firm*—Dunlap, Codding & Rogers, P.C.

(57) ABSTRACT

A grappling hook comprising a shaft, a head member, a plurality of blades, and a locking ring. The shaft has a first end. The head member is secured to the first end of the shaft. Each of the blades includes at least one gripping tooth for gripping onto a desired supporting structure. Each of the blades is pivotally connected to the head member such that each blade is movable between an operational position and a collapsed position wherein the blades are spread away from the head member and positioned to grip the supporting structure in the operational position, and wherein the blades are positioned adjacent to the shaft in the collapsed position. The locking ring is movable between an open position and a closed position wherein the locking ring secures the blades in the operational position when the locking ring is positioned in the open position, and wherein the locking ring secures the blades in the collapsed position when the locking ring is in the closed position.

1 Claim, 6 Drawing Sheets

COLLAPSIBLE GRAPPLING HOOK

CROSS REFERENCE TO RELATED APPLICATIONS

The present patent application is a continuation of U.S. Ser. No. 10/367,554, filed on Feb. 13, 2003, now abandoned which is a continuation of U.S. Ser. No. 09/993,861, filed on Nov. 14, 2001, now U.S. Pat. No. 6,530,614 issued on Mar. 11, 2003, which claims priority to the provisional patent application identified by U.S. Ser. No. 60/248,383, filed on Nov. 14, 2000. Each of the before-mentioned applications are hereby expressly incorporated herein by reference.

BACKGROUND OF THE INVENTION

Not Applicable.

SUMMARY OF THE INVENTION

Not Applicable.

DETAILED DESCRIPTION OF THE INVENTION

Figure 1:
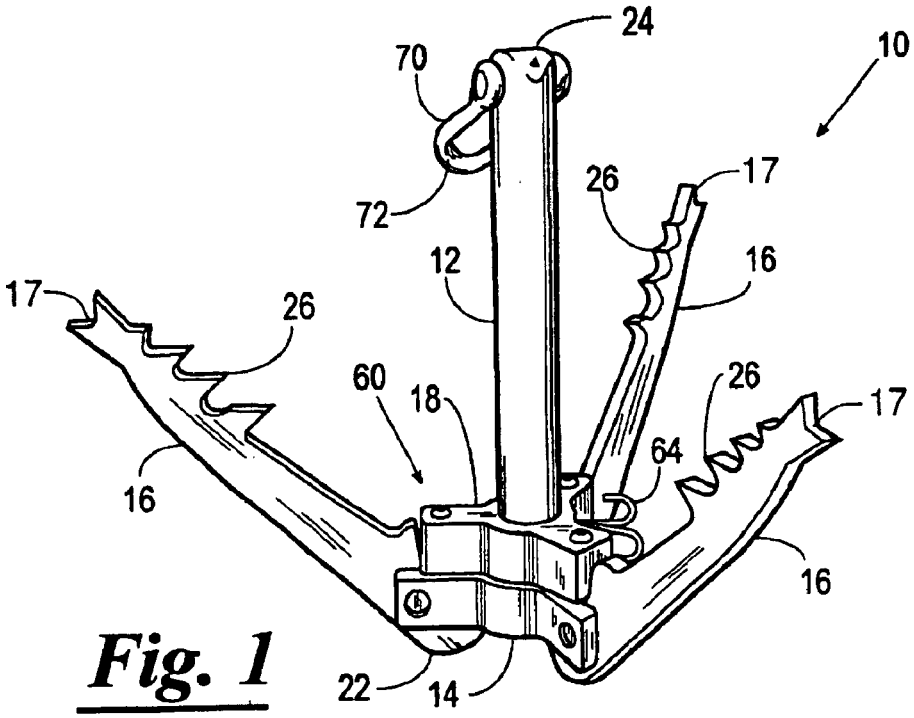
FIG. 1 is a side perspective view of a grappling hook constructed in accordance with the present invention wherein the grappling hook is in an operational position.

Referring now to the drawings, and in particular to FIG. 1, shown therein and designated by a reference numeral 10 is a grappling hook constructed in accordance with the present invention. In the preferred embodiment shown in the drawings, the grappling hook 10 can be closed for ease of storage and carrying and opened and deployed without the use of any tools. The grappling hook 10 will normally be thrown by law enforcement personnel, rescue workers, military person or a sports climber to grab a roof, window, ledge, rock outcropping or other structure securely. Once the grappling hook 10 is secured to the structure securely, the law enforcement personnel, rescue workers, military person or a sports climber can climb up a rope connected to the grappling hook 10. The grappling hook 10 can also be used to clear obstacles and paths of booby traps and mines.

Figure 2:
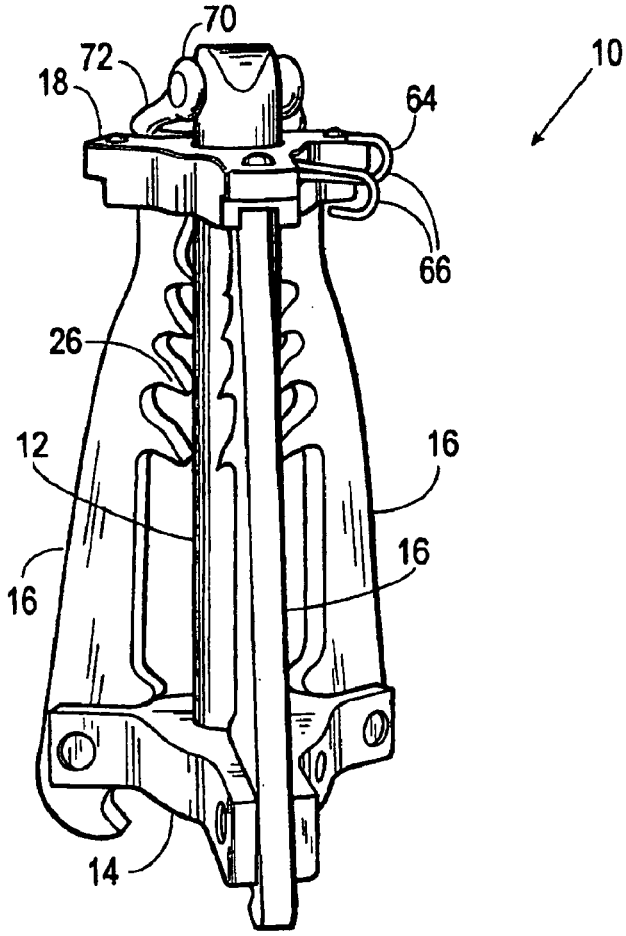
FIG. 2 is a side perspective view of the grappling hook depicted in FIG. 1, wherein the grappling hook is in a collapsed position.
Figure 3:
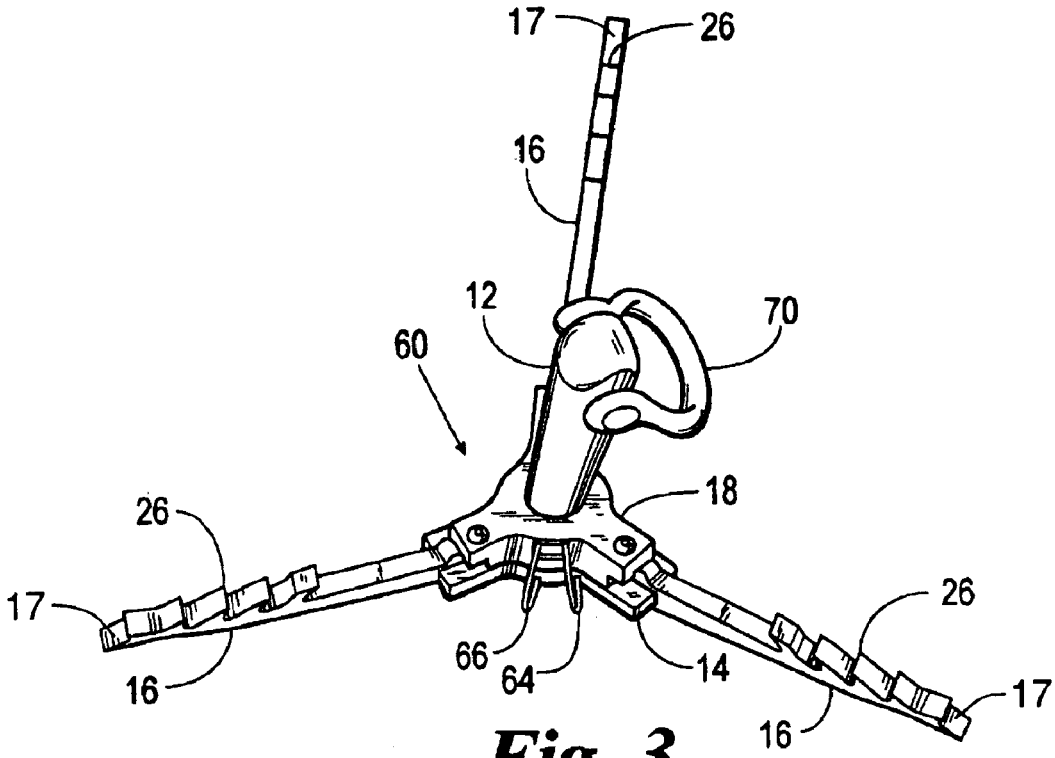
FIG. 3 is a top view of the grappling hook in the operational position.

In general, the grappling hook 10 is provided with a shaft 12, a head member 14, a plurality of blades 16, and a locking ring 18. The shaft 12 has a first end 22, and a second end 24. The head member 14 is secured to the first end 22 of the shaft 12. Each of the blades 16 has a distal end 17 and at least one and preferably a plurality of gripping teeth 26 for gripping onto the desired supporting structure. The distal end 17 of each blade 16 is provided with a substantially v-shaped or hook configuration so that the distal end 17 of each of the blades 16 is adapted to penetrate or dig into a crack, a root or any supporting structure to secure the grappling hook 10 to such a structure. As will be described in more detail hereinafter, the distal end 17 of the blades 16 can cooperate with the gripping teeth 26 to engage the supporting structure when the grappling hook 10 is in an operational position. Each of the blades 16 is pivotally connected to the head member 14 such that each blade 16 is movable between an operational position (FIG. 1) and a collapsed position (FIG. 2). In the operational position, the blades 16 are spread away from the head member 14 and positioned to grip the supporting structure. In the collapsed position, the blades 16 are positioned adjacent to the shaft 12 so as to provide for ease of storage and carrying.

The locking ring 18 is movable between an open position (FIG. 1) and a closed position (FIG. 2) wherein the locking ring 18 secures the blades 16 in the operational position when the locking ring is positioned in the open position, and wherein the locking ring 18 secures the blades 16 in the collapsed position when the locking ring is in the closed position.

Figure 4:
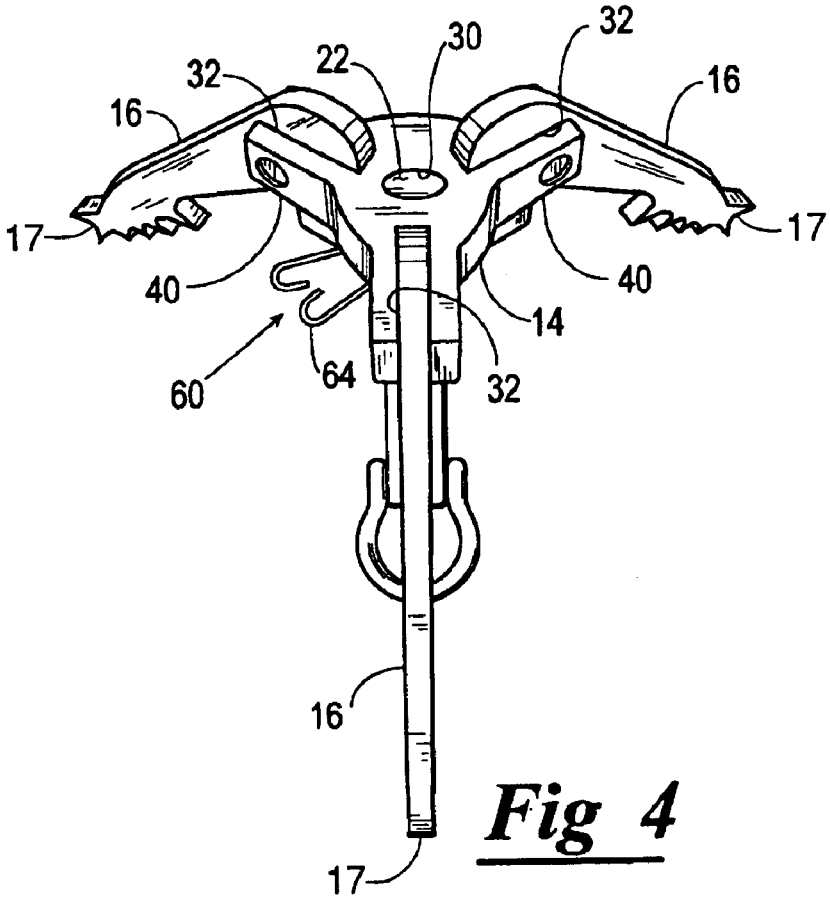
FIG. 4 is a bottom view of the grappling hook in the operational position.
Figure 5:
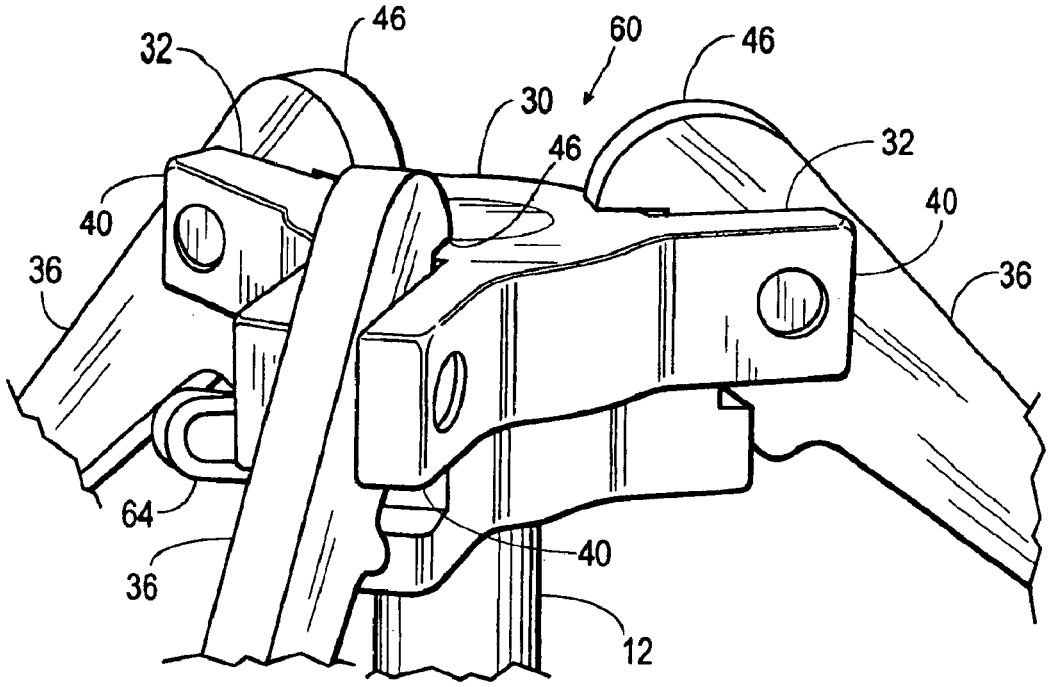
FIG. 5 is a perspective view of a head member of the grappling hook.
Figure 6:
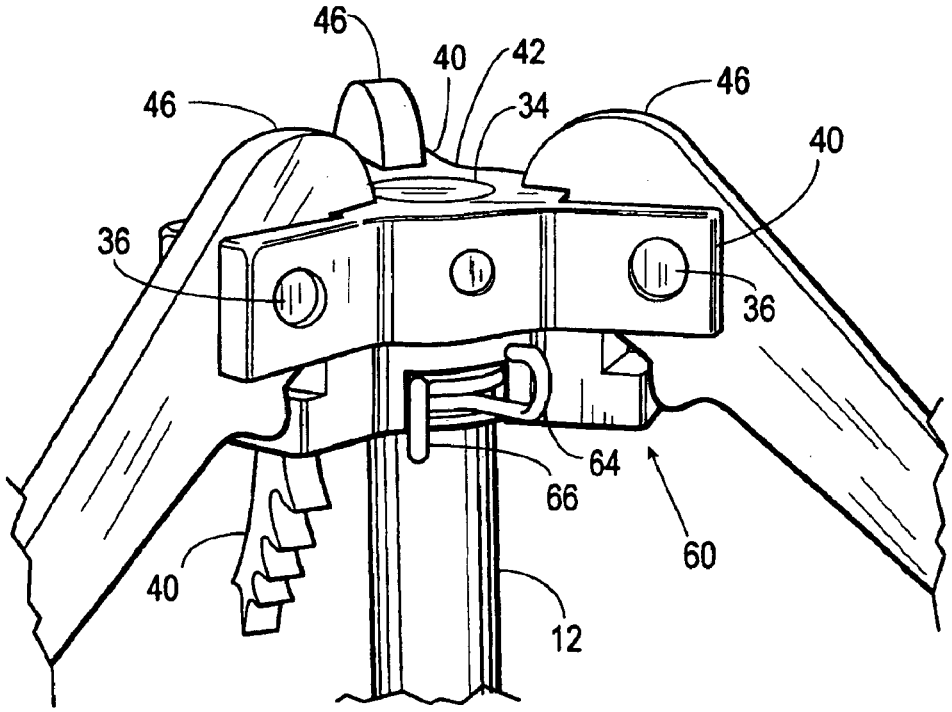
FIG. 6 is another perspective view of the head member of the grappling hook.

As shown in FIGS. 4 and 5, to secure the head member 14 to the shaft 12 and the blades 16, the head member 14 defines a shaft opening 30, and a plurality of notches 32. The shaft opening 30 receives the first end 22 of the shaft 12. The shaft 12 is secured in the shaft opening 30 via any suitable mechanical and/or chemical fastener, such as a pin 34 (FIG. 6) positioned within the head member 14 and the shaft 12. Alternatively, the shaft 12 can be secured to the head member via a screw, weld, epoxy or the like.

Each of the notches 32 receives one of the blades 16. A plurality of pins 36 extend through respective portions of the head member 14 and the respective blades 16 such that one pin 36 securely and pivotally attaches each of the blades 16 to the head member 14. As an optional feature, the head member 14 can include a plurality of outwardly extending arms 40 preferably forming a substantially star shaped pattern. In the embodiment shown in the drawings, each of the notches 32 is formed within one of the arms 40. The head member 14 is also provided with a lower surface 42, and an upper surface 44.

The grappling hook 10 can be provided with any number of blades 16 desired. As an example, the grappling hook 10 shown in FIG. 1 is provided with three blades, which are uniformly spaced apart about the shaft 12. Each of the blades 16 includes a shoulder 46 extending past the lower surface 42 of the head member 14. The shoulder 46 of each of the blades 16 engages the lower surface 42 of the head member 14 when the blade is positioned in the open or operational position. Thus, the shoulder 46 maintains the blade 16 in the open or operational position when force is applied to the blade 16.

Figure 8:
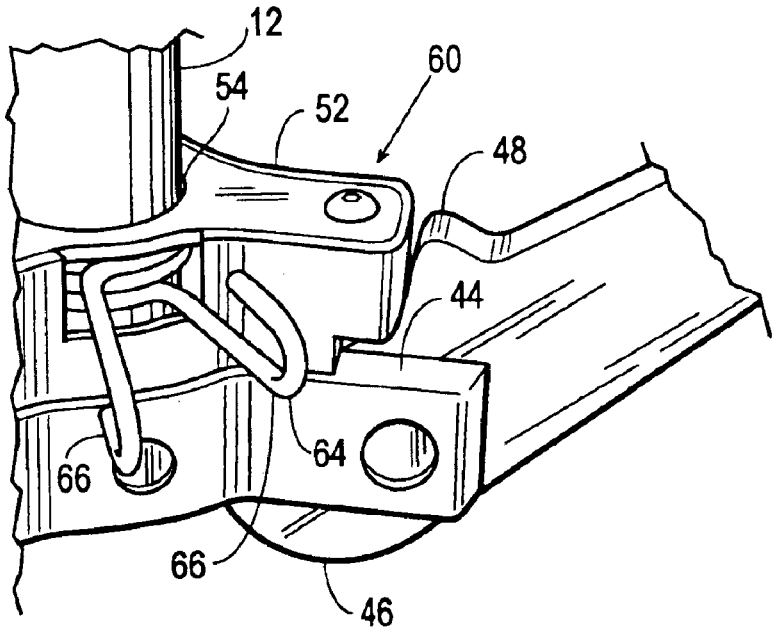
FIG. 8 is a perspective view showing the locking ring of FIG. 7 engaging a stop member of a blade for maintaining the blade in the operational position.
Figure 9:
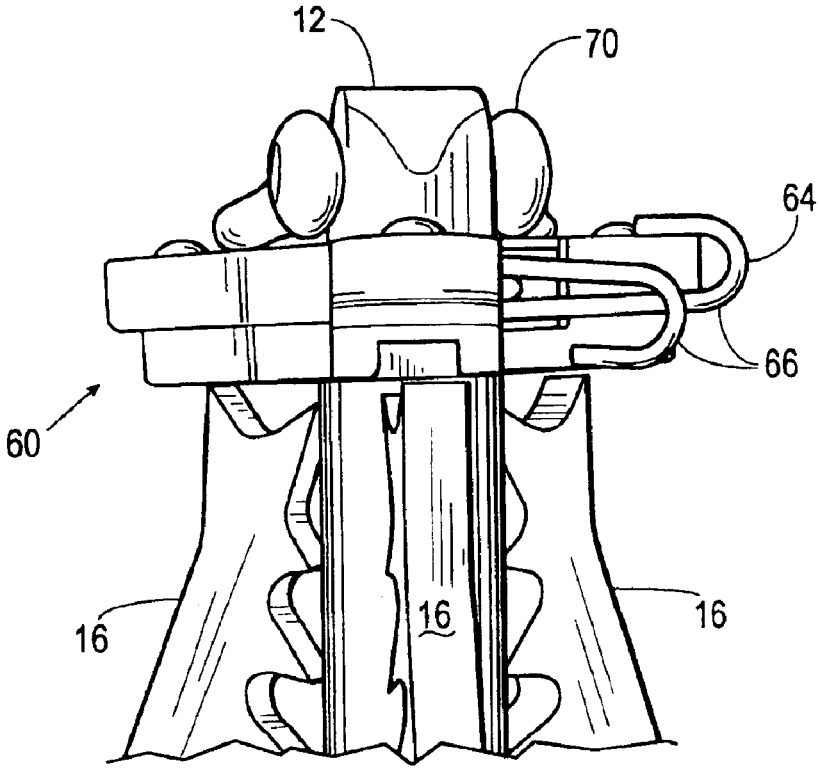
FIG. 9 is a perspective view showing the locking ring in an unlocked position.

Each of the blades 16 is also provided with a stop member 48 (FIG. 8) positioned above the upper surface 44 of the head member 14 for engaging the locking ring 18 when the locking ring 18 is positioned in the open position. Thus, the stop member 48 cooperates with the locking ring 18 to maintain the blade 16 in the operational position.

Figure 7:
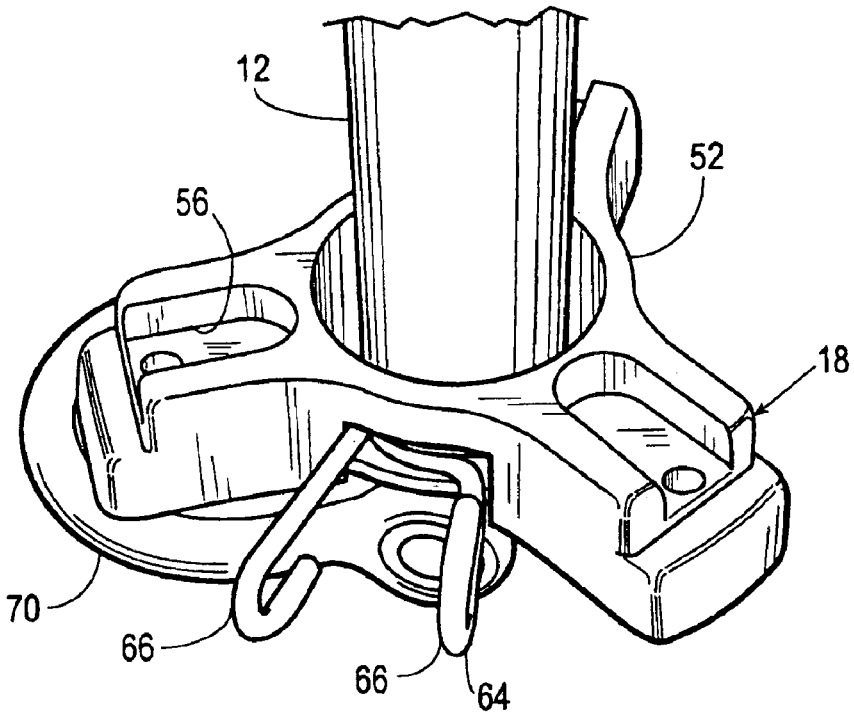
FIG. 7 is a perspective view of a locking ring of the grappling hook.
Figure 10:
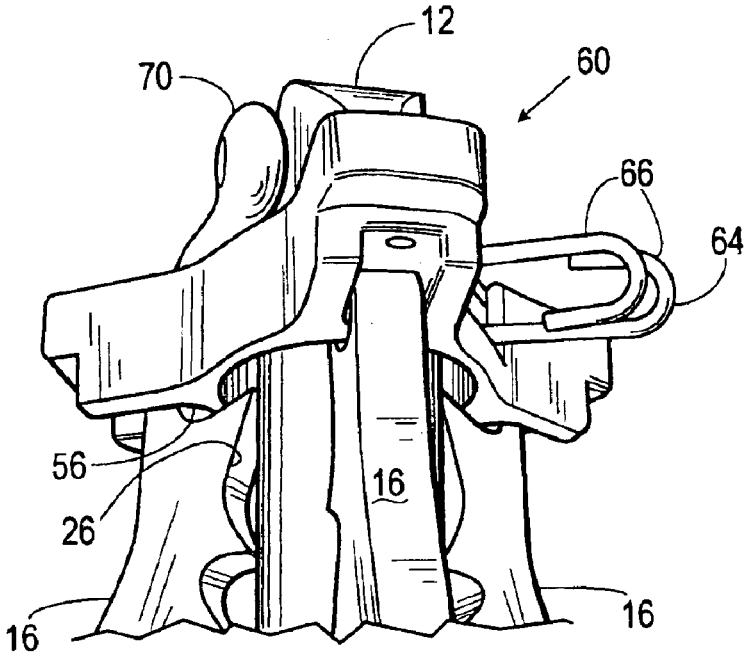
FIG. 10 is a perspective view showing the locking ring in a closed position.
Figure 11:
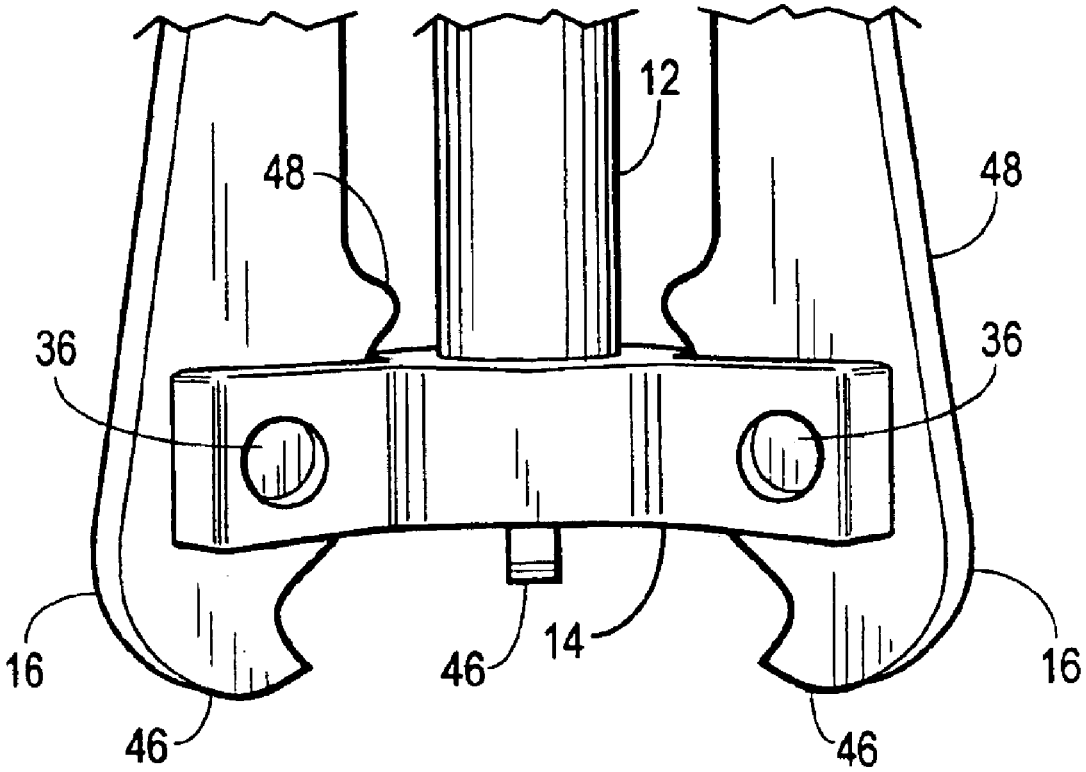
FIG. 11 is a perspective view showing a portion of a blade of the grappling hook.

The locking ring 18 is provided with a body portion 52. The body portion 52 defines a bore 54 (FIG. 8), and one or more recess 56 (FIG. 7). The bore 54 receives the shaft 12 such that the body portion 52 of the locking ring 18 is movable on the shaft 12 between the open and closed positions. As shown in FIG. 10, in the closed position, the recess 56 receives at least a portion of each of the blades 16 (when the blades 16 are in the collapsed position) to secure the blades 16 in the collapsed position. For example, the recess 56 can receive at least one of the gripping teeth 26 of the blades 16. Although in FIG. 7, one recess 56 is shown for receiving one or more of the gripping teeth 26 of each of the blades, it should be understood that more than one recess 56 could be provided. For example, one recess 56 could be formed in the body portion 52 for each of the blades 16.

The locking ring 18 is also provided with a locking assembly 60 for selectively permitting and restricting movement of the locking ring 18 on the shaft 12. In general, the locking assembly 60 can be any device capable of securing the locking ring 18 in the open position and/or the closed position. For example, the locking assembly 60 can be threads positioned on selected portions of the shaft 12 and the body portion 52, a screw which is finger tightened or loosened, or as shown in the figures, a spring clamp 64 which engages at least a portion of the body portion 52 and operates around the shaft 12. The spring clamp 64 is positioned with a cavity (not shown) defined by the body portion 52. The spring clamp 64 includes a pair of tabs 66 extending from the cavity which can be squeezed by hand to cause the spring clamp 64 to selectively engage and disengage the shaft 12. For example, the spring clamp 64 can operate in a similar manner to a hose clamp.

A connector assembly 70 is connected to the shaft 12. The connector assembly 70 defines a loop 72 for receiving a cable or a rope (not shown). The connector assembly 70 can be any device capable of connecting the shaft 12 to a rope or a cable, such as a hole formed in the shaft 12 or a shackle constructed of a rigid, resilient material, such as steel. In a preferred embodiment, the connector assembly 70 is a shackle constructed of Wichard stainless steel, and is rated at 3,500 pounds. The shaft 12, head member 14, blades 16 and locking ring 18 are desirably constructed of a rigid, yet light weight material, such as a rigid composite material, or aluminum. For example, the shaft 12, head member 14, blades 16 and locking ring 18 can be constructed of machined mil-spec 7075-T651 aluminum.

The size of the grappling hook 10 can vary depending on the intended use of the grappling hook 10. In one preferred embodiment, the grappling hook 10 has a height (in the collapsed position) of 7.5 inches, and a width (in the collapsed position) of 4 inches. In this embodiment, the grappling hook 10 weighs approximately 1.5 pounds, and when constructed of the machined mil-spec 7075-T651 aluminum is rated at about 1,650 pounds. This size of the grappling hook 10 can be disposed within a military canteen pouch for ease of storage and carrying.

Although the shaft 12, head member 14, and the blades 16 are shown as being integrally formed one piece units, it should be understood that the present invention is not limited to the shaft 12, the head member 14 and the blades 16 being one piece units, unless such limitation is set forth in the claims. In certain instances, it may be desirable for one or more of the shaft 12, head member 14 and blades 16 to be constructed of more than one component.

In use, the grappling hook 10 is carried to a selected location by a user while the grappling hook 10 is in the collapsed position. The user then manipulates the locking assembly 60 so as to move the locking ring 18 to an unlocked position toward the connector assembly 70. In the unlocked position, the blades are removed from the recess 56 formed in the body portion 52 of the locking ring 18. The blades 16 are then pivoted or otherwise moved outwardly away from the shaft 12 to the operational position, i.e., until the shoulder 46 of each of the blades 16 engages the head member 14. While the blades 16 are in the operational position, the locking assembly 16 is then manipulated such that the body portion 52 of the locking ring 18 is moved downwardly on the shaft 12 until the body portion 52 is positioned (in the open position) adjacent to the stop members 48 provided on the blades 16. The grappling hook 10 can then be thrown or otherwise used in a manner well known in the art. The process described above is then reversed when it is desirable to move the blades 16 from the operational position to the collapsed position.

The foregoing is considered as illustrative only of the principles of the invention. Further, since numerous modifications and changes will readily occur to those skilled in the art, it is not desired to limit the invention to the exact construction and operation shown and described above. Therefore, changes may be made in the combinations, operations, and arrangements of the various parts and elements described herein without departing from the spirit and the scope of the invention as defined in the following claim.

What is claimed is:

1. A grappling hook, comprising:

a shaft having a first end, and a second end;

a head member secured to the shaft;

a plurality of blades, each of the blades having a distal end forming a substantially v-shaped notch forming a pair of projections and at least one gripping tooth positioned along a portion of one side of each of the blades, each of the blades connected to the head member such that each blade is movable between an operational position and a collapsed position, wherein in the operational position the blades are spread away from the head and positioned such that the blades engage and grip a supporting structure via the at least one gripping tooth and the distal end of each blade, in the collapsed position the blades are positioned substantially adjacent the shaft; and means for selectively securing the blades in one of the operational position and the collapsed position; and wherein each blade has a stop member positioned above an upper surface of the head member for engaging the means for securing the blades in one of the operational position and the collapsed position.

* * * * *